US010603937B2

(12) United States Patent
Yoon et al.

(10) Patent No.: US 10,603,937 B2
(45) Date of Patent: Mar. 31, 2020

(54) PHOTO PRINTER AND METHOD FOR MANUFACTURING THE SAME

(71) Applicant: DS GLOBAL, Seoul (KR)

(72) Inventors: Hee Pil Yoon, Seoul (KR); Gu berm Jung, Bucheon-si (KR)

(73) Assignee: DS GLOBAL, Seoul (KR)

( * ) Notice: Subject to any disclaimer, the term of this patent is extended or adjusted under 35 U.S.C. 154(b) by 0 days.

(21) Appl. No.: 16/129,004

(22) Filed: Sep. 12, 2018

(65) Prior Publication Data

US 2019/0160838 A1 May 30, 2019

(30) Foreign Application Priority Data

Nov. 27, 2017 (KR) ..... 10-2017-0159132

(51) Int. Cl.

| | |
|---|---|
| ***B41J 2/32*** | (2006.01) |
| ***B41J 25/308*** | (2006.01) |
| ***B41J 11/04*** | (2006.01) |
| ***B41J 2/335*** | (2006.01) |

(52) U.S. Cl.

CPC ..... *B41J 25/308* (2013.01); *B41J 2/32* (2013.01); *B41J 2/335* (2013.01); *B41J 11/04* (2013.01); *B41J 2202/31* (2013.01)

(58) Field of Classification Search

CPC ..... B41J 2/32; B41J 2/335; B41J 11/04; B41J 25/308

See application file for complete search history.

(56) References Cited

FOREIGN PATENT DOCUMENTS

KR 20180010927 1/2018

*Primary Examiner* — Lamson D Nguyen

(74) *Attorney, Agent, or Firm* — Cantor Colburn LLP

(57) ABSTRACT

Provided is a photo printer and a method for manufacturing the same that are capable of allowing a gap formed between a head and a platen roller to be kept constantly. The photo printer includes: a frame having both side walls; a paper accommodating part disposed between both side walls of the frame to accommodate the paper therein; a pickup roller located protrudingly from a bottom surface of the paper accommodating part to forward feed the paper accommodated in the paper accommodating part; a platen roller coupled to the frame to discharge the paper fed from the pickup roller forward; a head disposed above the platen roller to apply the heat to the paper; and a pair of brackets each having one side swingably coupled to the head and the other side hinge-coupled to the frame.

10 Claims, 6 Drawing Sheets

PHOTO PRINTER AND METHOD FOR MANUFACTURING THE SAME

TECHNICAL FIELD

The present invention relates to a photo printer, and more particularly, to a photo printer and a method for manufacturing the same that are capable of allowing a gap formed between a head and a platen roller to be kept constantly.

BACKGROUND ART

A camera mounted on a smart device like a smartphone has similar performance to a general digital camera, and many people have taken their pictures with their smart device carried always with them, not with a digital camera. Accordingly, a consumer's desire to take his or her picture and to instantly print the picture, without any separate conversion, has been gradually increased.

So as to satisfy such consumer's desire, photo printers have been proposed so that pictures on smartphones can be instantly printed whenever and wherever.

There are various kinds of photo printers, but among them, particularly, a photo printer is proposed wherein printing paper to which a zero-ink printing technology is adopted is used, thereby requiring no ink or cartridge to reduce the maintenance cost thereof. In case of such zero-ink printing technology, the part corresponding to the cartridge is contained in the paper, and accordingly, only heat is used to express colors. That is, dyes, which respond to heat and thus express colors, are laminated on the paper, so that the heating temperature or heating time of a head is controlled to print images (pictures) or texts.

Referring to FIGS. 1 to 3, a conventional photo printer 100 includes a base 110, a pickup roller R1, a platen roller R2, a head 140, swing brackets 150, and pressurizing means 160.

The base 110 has a paper feeding part 111 disposed thereon to stackedly accommodate paper sheets therein and a lower base 115 extended forward from the underside thereof.

The pickup roller R1 protrudes from the bottom surface of the paper feeding part 111 of the base 110 to forward feed the paper located at the lowermost position among the stacked paper.

The platen roller R2 is adapted to discharge the paper fed by the pickup roller R1 forward and has a rotary shaft coupled to the lower base 115.

The head 140 is disposed above the platen roller R2 and is adapted to apply given heat to the paper to express colors corresponding to the given heat, thereby printing images or texts. Further, a ceramic plate (not shown) is disposed on top of the head 140, and a heat radiating plate 141, which is made of a metal material, is placed on top of the ceramic plate.

Further, a PCB 142 is provided to control a heating temperature and heating time of the head 140. That is, the head 140 and the PCB 142 are attached to the underside of the heat radiating plate 141.

The paper enters a space between the head 140 and the platen roller R2, and according to the present invention, especially, the head 140 is rotatably mounted onto the base 110. In detail, the head 140 is coupled to a mounting part 151 disposed on the front sides of the swing brackets 150.

So as to allow the space between the head 140 and the platen roller R2 to be widened at the time when the paper enters the space between the head 140 and the platen roller R2, further, hinge holes 152 are formed on the rear sides of the swing brackets 150 in such a manner as to be coupled to rotary shafts 113 disposed on the side walls of the base 110.

Furthermore, the head 140 comes into close contact with the paper to apply the heat to the paper, and so as to allow the head 140 to come into close contact with the paper, the pressurizing means 160 is provided to pressurize the head 140 downward. The pressurizing means 160 includes a pressurizing part 161 for pressurizing top of the head 140 and hinge holes 162 for rotating the pressurizing part 161 coaxially with respect to the rotary shaft 113.

Even though the top of the head 140 is pressurized against the pressurizing means 160, locking projections 153 of the swing brackets 150 are locked onto stoppers 115*a* formed on both sides of the base 110, and accordingly, they are not descended anymore, so that the head 140 does not come into contact with the platen roller R2, thereby forming a gap from the platen roller R2.

Under the configuration of the conventional photo printer, like this, the formation of the gap between the head 140 and the platen roller R2 at the time when the head 140 is coupled is achieved by means of the locking projections 153 and the stoppers 115*a*, which undesirably causes the gap to be not maintained constantly. In more detail, gaps on both sides of the head 140 may be different from each other due to mechanical errors of the locking projections 153 and the stoppers 115*a*, and further, gaps after assembled may be different from set gaps.

[National Research and Development Program Supporting the Invention] Industrial Technology Innovation Program
[Project No.] 10080144
[Ministry Name] Ministry of Trade, Industry and Energy
[Research Management Agency] Korea Evaluation Institute of Industrial Technology
[Research Project Name] Material Component Technology Development Project (Investor-linked type Technology Development Project)
[Research Project Name] Development of ultra slim engine for zero ink type mobile printer
[Contribution Rate] 1/5
[Host Institution] DS Global Co., Ltd
[Period of Time for Research] Aug. 1, 2017 to Dec. 31, 2019

PRIOR ART DOCUMENT

Patent Document

Patent Document 1 Korean Patent Application Laid-open No. 10-2016-116966

DISCLOSURE

Technical Problem

Accordingly, the present invention has been made in view of the above-mentioned problems occurring in the prior art, and it is an object of the present invention to provide a photo printer and a method for manufacturing the same that are capable of allowing a gap formed between a head and a platen roller to be kept constantly.

Technical Solution

To accomplish the above-mentioned object, according to a first aspect of the present invention, there is provided a photo printer for applying given heat to paper expressing colors in response to the heat to print images or texts, the photo printer including: a frame having both side walls; a paper accommodating part disposed between both side walls of the frame to accommodate the paper therein; a pickup roller located protrudingly from a bottom surface of the paper accommodating part to forward feed the paper accommodated in the paper accommodating part; a platen roller coupled to the frame to discharge the paper fed from the pickup roller forward; a head disposed above the platen roller to apply the heat to the paper; and a pair of brackets each having one side swingably coupled to the head and the other side hinge-coupled to the frame.

According to the present invention, desirably, the head has swing holes formed on both sides thereof and the brackets have swing protrusions adapted to be inserted into the swing holes.

According to the present invention, desirably, the frame has support projections formed thereon to form a given gap between the head and the platen roller.

According to the present invention, desirably, the brackets have stepped projections formed on the undersides thereof in such a manner as to be locked onto the support projections to form the given gap between the head and the platen roller.

According to the present invention, desirably, the brackets have hinge holes hinge-coupled to the frame, and the hinge hole of any one of the brackets is a long hole.

According to the present invention, desirably, the photo printer further includes fixing bolts adapted to fix the given gap formed between the head and the platen roller.

According to the present invention, desirably, the head has fastening holes adapted to fasten the fixing bolts thereto, and the brackets have fixing holes adapted to pass the fixing bolts therethrough, the fixing holes being long holes.

To accomplish the above-mentioned object, according to a second aspect of the present invention, there is provided a method for manufacturing a photo printer including the steps of: mounting a platen roller onto a frame; swingably coupling a pair of brackets to both sides of a head; hinge-coupling one end of the pair of brackets to the frame; swinging the head with respect to the brackets form a given gap between the head and the platen roller; and fixing the brackets and the head to each other by means of fixing bolts to maintain the given gap.

According to the present invention, desirably, the head has fastening holes adapted to fasten the fixing bolts thereto, and the brackets have fixing holes adapted to pass the fixing bolts therethrough, the fixing holes being long holes.

Advantageous Effects

According to the present invention, the photo printer and the method for manufacturing the same are capable of allowing the gap formed between the head and the platen roller to be kept constantly.

As a result, the photo printer and the method for manufacturing the same are capable of improving a quality of print.

MODE FOR INVENTION

Hereinafter, an explanation on a configuration and an operation of a photo printer according to the present invention will be in detail given with reference to the attached drawing.

Figure 1:
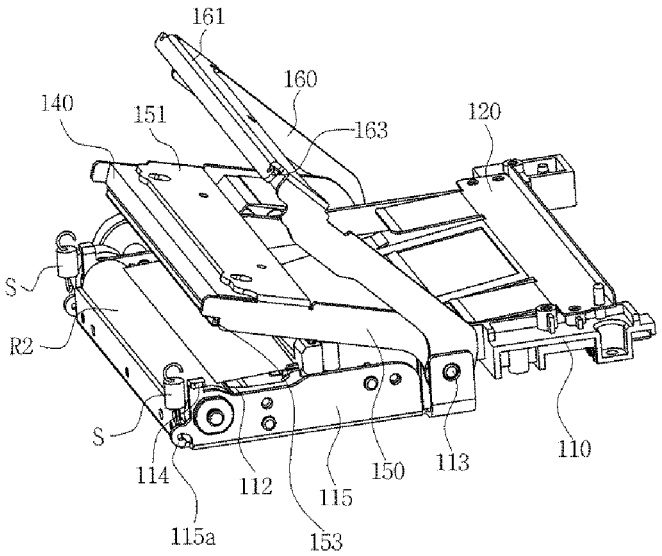
Fig. 1 Prior Art
FIGS. 1 to 3 show a conventional photo printer.
Figure 2:
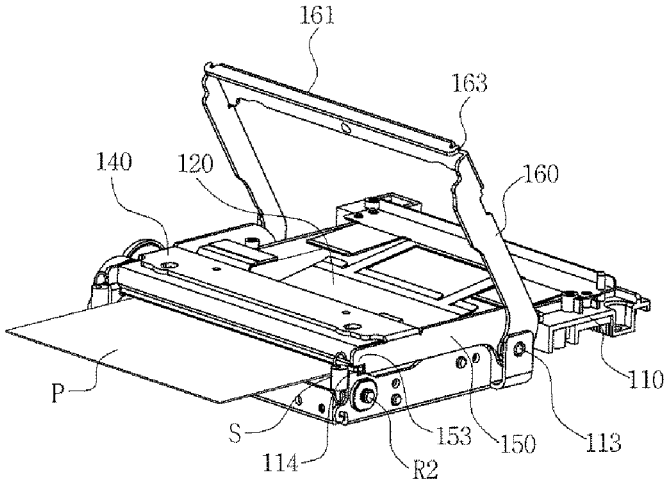
Fig. 2 Prior Art
Figure 3:
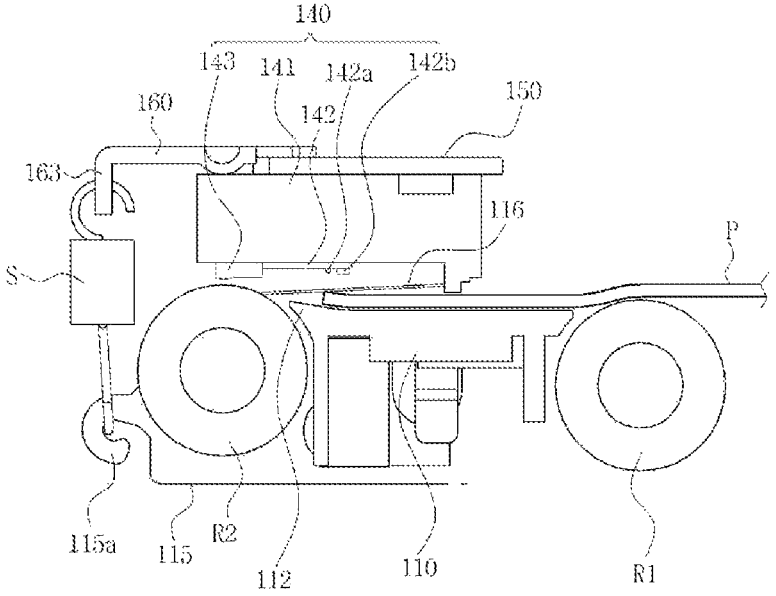
Fig. 3 Prior Art
Figure 4:
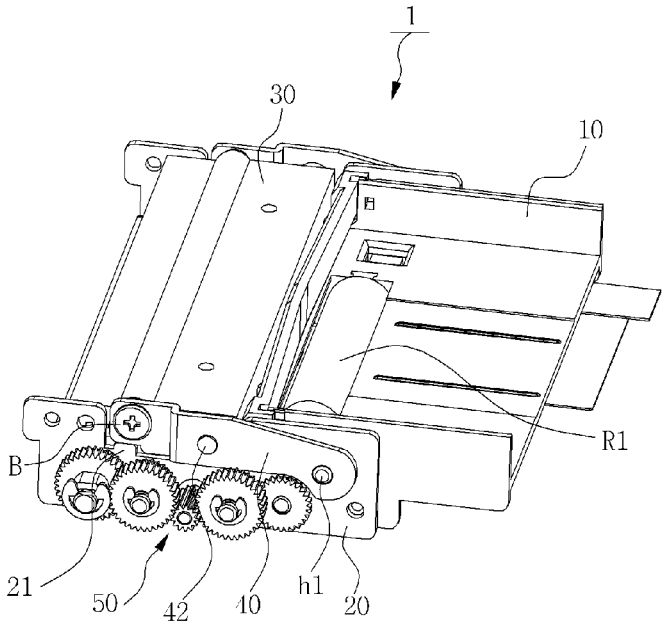
FIGS. 4 to 8 show a photo printer according to the present invention.
Figure 5:
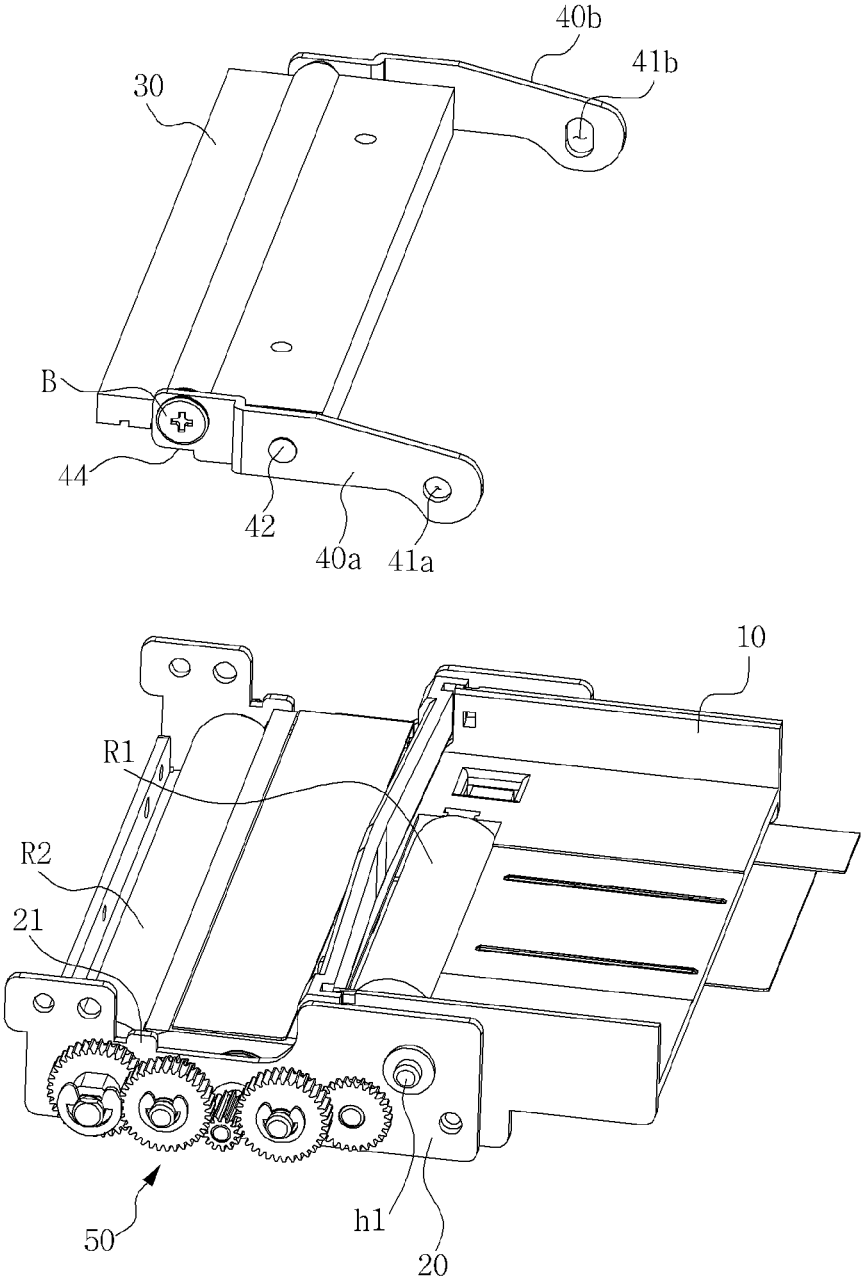

As shown in FIGS. 4 and 5, a photo printer 1 according to the present invention includes a paper accommodating part 10 disposed between both side walls of a frame 20 to accommodate paper therein.

Further, a pickup roller R1 is located protrudingly from a bottom surface of the paper accommodating part 10 to forward feed the paper accommodated in the paper accommodating part 10.

Also, a platen roller R2 is coupled to the frame 10 to discharge the paper fed from the pickup roller R1 forward.

A drive-train 50 is provided to rotate the platen roller R2 and the pickup roller R1.

A head 30 is disposed above the platen roller R2 to apply heat to the paper.

The head 30 is swingably coupled to a bracket 40 having a pair of brackets 40*a* and 40*b*, and the brackets 40*a* and 40*b* are hinge-coupled to the frame 20.

Figure 6:
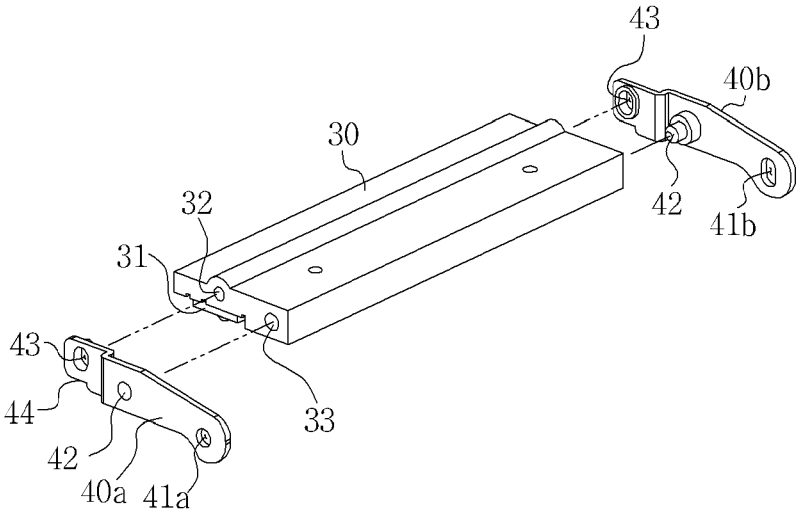
Figure 7:
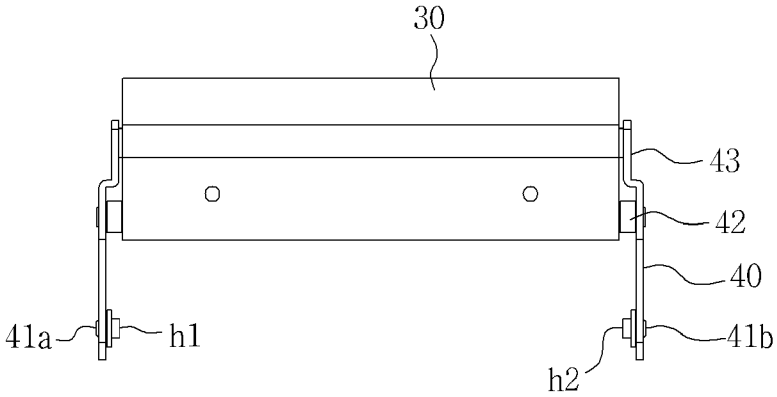
Figure 8:
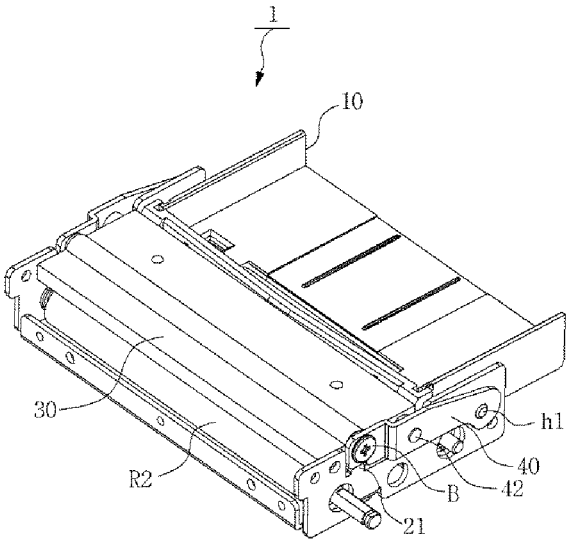

Referring to FIGS. 5 to 7, the head 30 has a heat emitting element 31 disposed on the underside thereof and fastening holes 32 and swing holes 33 formed on both sides thereof.

Also, both sides of the head 30 are coupled to the pair of first and second brackets 40*a* and 40*b*. In detail, the first and second brackets 40*a* and 40*b* are plate-shaped and have swing protrusions 42 protruding inward therefrom in such a manner as to be press-fitted to the swing holes 33. Accordingly, the head 30 is swingably coupled to the first and second brackets 40*a* and 40*b*, thereby adjusting a gap from the platen roller R2.

Further, the first and second brackets 40*a* and 40*b* have hinge holes 41*a* and 41*b* formed on one end thereof around the swing protrusions 42 in such a manner as to insert hinge pins h1 and h2 of the frame 20 thereinto. According to the present invention, the hinge hole 41*a* of the first bracket 40*a* is a hole having a shape of a circle, but the hinge hole 41*b* of the second bracket 40*b* is a long hole extended in a vertical direction. Since the second bracket 40*b* is the long hole, therefore, the left and right balance of the head 30 can be adjusted.

Furthermore, the first and second brackets 40*a* and 40*b* have fixing holes 43 formed on the other end thereof around the swing protrusions 42. The fixing holes 43 of the first and second brackets 40*a* and 40*b* are long holes extended in a vertical direction.

Referring to FIGS. 5 to 9, an explanation on a process of forming the gap between the platen roller R2 and the head 30 in the photo printer according to the present invention and on a method for manufacturing the photo printer according to the present invention will be given below.

First, the paper accommodating part 10 and the platen roller R2 are coupled to the frame 20.

Next, the swing protrusions 42 of the bracket 40 are press-fitted to the swing holes 33 formed on both sides of the head 30.

Next, the hinge holes 41*a* and 41*b* of the bracket 40 are swingably coupled to the hinge pins h1 and h2 of the frame 20. At this time, stepped projections 44 of the bracket 40 are locked onto support projections 21 of the frame 20, and accordingly, the bracket 40 is not descended anymore, so that the gap is primarily formed between the platen roller R2 and the head 30.

Next, the gap formed between the platen roller R2 and the head 30 by means of the support projections 21 and the stepped projections 44 is measured through a vision camera or gauge, and after the measurement, the gap is adjusted to a set gap.

If the measured gap is greater than the set gap, for example, the front side of the head 30 swings downward from the bracket 40 to allow the gap to be decreased. Like this, if the gap is adjusted, fixing bolts B are fastened to firmly keep the adjusted gap (See (a) of FIG. 9).

If the measured gap is less than the set gap, contrarily, the front side of the head 30 swings upward from the bracket 40 to allow the gap to be increased. Like this, if the gap is adjusted, the fixing bolts B are fastened to firmly keep the adjusted gap (See (b) of FIG. 9).

Figure 9:
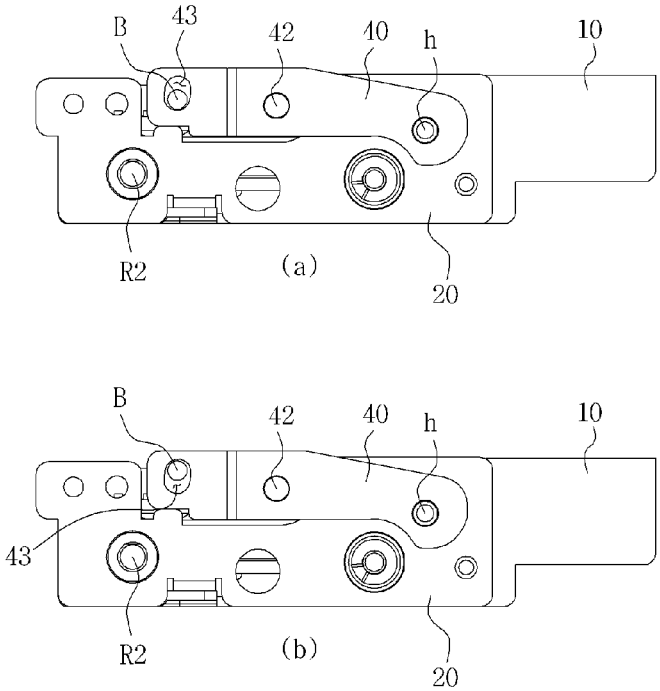
FIGS. 9 and 10 show a method for manufacturing the photo printer according to the present invention.

Reference symbols "B" of FIG. 9 indicate the fixing bolts, but to understand the above-mentioned processes, only portions where screws are formed on the fixing bolts are illustrated, while head portions on which cross lines are formed are being not illustrated.

Like this, the formation of the gap between the platen roller R2 and the head 30 and the method for fixing the formed gap have been explained above.

Next, a method for adjusting a horizontal level of the head 30 will be explained. In detail, if the head 30 is inclined toward any one side, the inclination is adjusted to the horizontal level to allow the gap between the platen roller R2 and the head 30 to be constant, without any deviation to left and right sides of the head 30.

As mentioned above, the gap between the platen roller R2 and the head 30 is measured through the vision camera or gauge, and after that, if left and right gaps of the head 30 from the platen roller R2 are different from each other, the gap adjustment is carried out by means of the second bracket 40*b*, not by means of the first bracket 40*a*.

Figure 10:
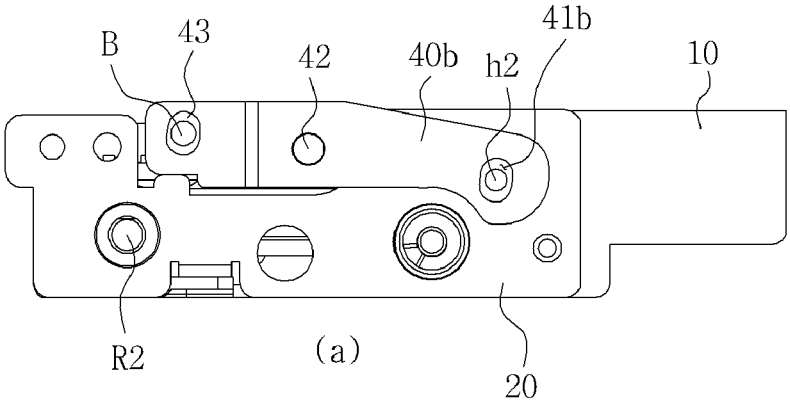
Figure 10:
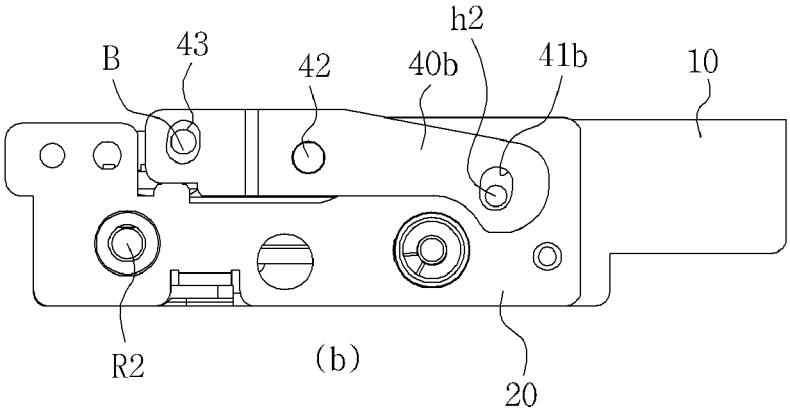

In more detail, in a state of (a) of FIG. 10, that is, in a state where the hinge pin h2 is fixedly located at the center of the hinge hole 41*b*, the gap between the platen roller R2 and the head 30 is measured through the vision camera or gauge.

If it is measured that the gap on the side where the second bracket 40*b* is coupled to the head 30 is less than the opposite gap to the gap, that is, if it is checked that the head 30 to which the second bracket 40*b* is coupled is inclined downward, one end of the second bracket 40*b* is lifted to allow the head 30 to be adjusted horizontally on the left and right sides and then fixed at the state. In this case, the hinge pin h2 is fixed down from the center of the hinge hole 41*b* (See (b) of FIG. 10).

If it is checked that the head 30 to which the second bracket 40*b* is coupled is inclined upward, one end of the second bracket 40*b* is descended to allow the head 30 to be adjusted horizontally on the left and right sides and then fixed at the state. In this case, the hinge pin h2 is fixed up from the center of the hinge hole 41*b*.

The invention claimed is:

1. A photo printer for applying given heat to paper expressing colors in response to the heat to print images or texts, the photo printer comprising:

a frame having both side walls;

a paper accommodating part disposed between both side walls of the frame to accommodate the paper therein;

a pickup roller located protrudingly from a bottom surface of the paper accommodating part to forward feed the paper accommodated in the paper accommodating part;

a platen roller coupled to the frame to discharge the paper fed from the pickup roller forward;

a head disposed above the platen roller to apply the heat to the paper; and a pair of brackets each having one side swingably coupled to the head and the other side hinge-coupled to the frame, wherein the head has swing holes formed on both sides thereof and the brackets have swing protrusions adapted to be inserted into the swing holes.

2. The photo printer according to claim 1, wherein the frame has support projections formed thereon to form a given gap between the head and the platen roller.

3. The photo printer according to claim 2, wherein the brackets have stepped projections formed on the undersides thereof in such a manner as to be locked onto the support projections to form the given gap between the head and the platen roller.

4. The photo printer according to claim 1, wherein the brackets have hinge holes hinge-coupled to the frame, and the hinge hole of any one of the brackets is a long hole.

5. The photo printer according to claim 1, further comprising fixing bolts adapted to fix the given gap formed between the head and the platen roller.

6. The photo printer according to claim 5, wherein the head has fastening holes adapted to fasten the fixing bolts thereto, and the brackets have fixing holes adapted to pass the fixing bolts therethrough, the fixing holes being long holes.

7. A method for manufacturing a photo printer comprising the steps of:

mounting a platen roller onto a frame;

swingably coupling a pair of brackets to both sides of a head;

hinge-coupling one end of the pair of brackets to the frame;

swinging the head with respect to the brackets form a given gap between the head and the platen roller; and fixing the brackets and the head to each other by means of fixing bolts to maintain the given gap.

8. The method according to claim 7, wherein the head has fastening holes adapted to fasten the fixing bolts thereto, and the brackets have fixing holes adapted to pass the fixing bolts therethrough, the fixing holes being long holes.

9. A photo printer for applying given heat to paper expressing colors in response to the heat to print images or texts, the photo printer comprising:

a frame having both side walls;

a paper accommodating part disposed between both side walls of the frame to accommodate the paper therein;

a pickup roller located protrudingly from a bottom surface of the paper accommodating part to forward feed the paper accommodated in the paper accommodating part;

a platen roller coupled to the frame to discharge the paper fed from the pickup roller forward;

a head disposed above the platen roller to apply the heat to the paper; and a pair of brackets each having one side swingably coupled to the head and the other side hinge-coupled to the frame, wherein the frame has support projections formed thereon to form a given gap between the head and the platen roller.

10. The photo printer according to claim 9, wherein the brackets have stepped projections formed on the undersides thereof in such a manner as to be locked onto the support projections to form the given gap between the head and the platen roller.

* * * * *